US007414538B2

(12) United States Patent
Cook et al.

(10) Patent No.: US 7,414,538 B2
(45) Date of Patent: Aug. 19, 2008

(54) DETECTOR ASSEMBLY SUITED TO SMOKE ALARMS

(76) Inventors: Quentin David Cook, 256 Napier Street, Strathmore, 3041, Victoria (AU); Neale Terrens Kelly, 3 Fiona Court, Mooroolbark, 3138, Victoria (AU); Paul Edward Davies, 9 Trefoil Street, Fern Tree Gully, 3156, Victoria (AU)

( * ) Notice: Subject to any disclaimer, the term of this patent is extended or adjusted under 35 U.S.C. 154(b) by 209 days.

(21) Appl. No.: 10/539,263

(22) PCT Filed: Dec. 18, 2003

(86) PCT No.: PCT/AU03/01684

§ 371 (c)(1),
(2), (4) Date: Mar. 7, 2006

(87) PCT Pub. No.: WO2004/055750

PCT Pub. Date: Jul. 1, 2004

(65) Prior Publication Data

US 2006/0202849 A1 Sep. 14, 2006

(30) Foreign Application Priority Data

Dec. 18, 2002 (AU) ..... 2002953417

(51) Int. Cl.
*G08B 17/10* (2006.01)

(52) U.S. Cl. ..... 340/628; 340/693.2; 340/693.6; 340/693.7; 340/693.11

(58) Field of Classification Search ..... 340/628, 340/540, 541, 568.4, 635, 636.1, 652, 690, 340/693.2, 693.5, 693.6, 693.7, 693.9, 693.11; 439/500, 98; 429/96, 99

See application file for complete search history.

(56) References Cited

U.S. PATENT DOCUMENTS

| | | | | | |
|---|---|---|---|---|---|
| 4,257,039 | A * | 3/1981 | Webb et al. | ..... | 340/629 |
| 4,870,395 | A * | 9/1989 | Belano | ..... | 340/693.7 |
| 4,881,063 | A * | 11/1989 | Fawcett | ..... | 340/693.7 |
| 4,959,640 | A * | 9/1990 | Hall | ..... | 340/693.7 |
| 5,103,216 | A * | 4/1992 | Sisselman | ..... | 340/693.7 |
| 5,280,273 | A * | 1/1994 | Goldstein | ..... | 340/632 |
| 5,596,314 | A * | 1/1997 | Goldstein | ..... | 340/632 |
| 5,820,406 | A * | 10/1998 | Hetherington | ..... | 439/500 |
| 6,160,487 | A * | 12/2000 | DeLuca | ..... | 340/693.7 |
| 6,172,612 | B1 * | 1/2001 | Odachowski | ..... | 340/628 |
| 6,246,324 | B1 * | 6/2001 | Messenger et al. | ..... | 340/540 |

* cited by examiner

*Primary Examiner*—Brent Swarthout
(74) *Attorney, Agent, or Firm*—Klauber & Jackson

(57) ABSTRACT

A detector assembly (10) powered by mains electricity and an elongate backup battery (76) is disclosed. The assembly includes: a ceiling mountable base (10) having a body defining a downwardly opening socket (24); a detector module (20) having a battery support portion (75) for holding the battery (76) in a vertical orientation, the module (20) receivable by the socket (24); a quick connection means for mechanically and electrically connecting the module (20) to the base (10); and shutter (50) mounted to the base (10). The shutter (50) prevents operation of the quick connection means when no vertical battery (76) is installed within the module (20). The quick connection means comprises co-operable pairs of conductors. The conductor pairs transmit power from the base (10) to the module (20). The pairs of conductors each comprise a stud conductor mounted to the base (10) and a forked conductor mounted to the module (20).

23 Claims, 15 Drawing Sheets

DETECTOR ASSEMBLY SUITED TO SMOKE ALARMS

FIELD OF THE INVENTION

The present invention relates to alarm and/or detector assemblies such as smoke alarms and in particular to smoke alarms having a battery back up to a mains electricity power supply.

BACKGROUND TO THE INVENTION

Smoke alarms and carbon monoxide alarms are typically mounted at various locations around a house or other buildings to detect dangerous air quality conditions that may arise as a result of fire and give an alarm signal. Such alarm units must be highly reliable so that the alarm can detect conditions invisible to the human senses when the occupants of the building are asleep. Domestic smoke alarms in the past have typically been powered by a battery that gave about one year of normal operation. No connection to the mains circuit was made. Recent changes to regulations in many countries have mandated the use of fixed wiring to provide mains power combined with battery back up for loss of mains power in smoke alarms.

Most mains power smoke alarms found in Australia, having battery back up systems, use a plug in connector with a small flexible cable (flex) that requires a further termination box for connection usually fixed above the ceiling. This arrangement is not desirable for the installer as he/she is required to fix the terminal connection means to a fixing point as is required by the wiring rules, this usually necessitates entering the roof cavity, plus the extra cost to purchase the junction box.

The small connector plug and separate terminal housing referred to above is used in many countries around the world. The problem with this method of termination is the requirement for a separate terminal connection means plus the plug can get knocked out of its connection when insulation batts or the like are pulled over the smoke alarm. The cable length may also not reach a fixing point for the terminal box. In this case the electrician has to make a fixing point closer to the smoke alarm.

Other smoke alarms in the market have integrated the terminals within their mounting plates, but with the addition of terminals and the conventional layout of components such as the battery position the alarm becomes large and bulky making it less commercially acceptable. Batteries also require replacement annually, hence a simple means is required to allow the battery replacement. The alarm must also prevent the user from connection to the mains circuit without the battery fitted. Many designs for battery removal are available on the market. Most have complicated door mechanism that hide the battery some have complicated switching that allow the user to keep the mains connection but isolate the sense electronics when the battery door is open. In most cases the battery is hidden and is difficult for impaired persons to remove or understand how removal is achieved.

It is an object of the invention to overcome at least some of the problems outlined above.

BRIEF DESCRIPTION OF THE INVENTION

According to a first aspect of the invention there is provided a detector assembly powered by mains electricity and an elongate backup battery, the assembly comprising:

a ceiling mountable base having: a body defining a downwardly opening socket, a mouth within the socket for receiving a portion of the battery, and a means of connecting to the mains electricity;

a detector module having a battery support portion for holding the battery in a vertical orientation, the module receivable by the socket;

a quick connection means for mechanically connecting the detector module to the base;

a quick connection means for electrically connecting the detector module to the base, the electrical connection supplying power from the power supply means to the module; and a lockout means arranged to prevent operation of at least the mechanical quick connection means when no battery is installed within the detector module.

Preferably the lockout means comprises:

a blocking member pivotally mounted to the module for rotation from a blocking position to a retracted position; and a biasing means for biasing the blocking member into its blocking position when no battery is installed within the detector module.

Preferably the assembly is for use with a standard nine volt battery having an end face with a pair of projecting spaced apart snap connectors, wherein the battery support portion comprises a pair of standard upwardly facing snap connectors arranged and constructed to engage the snap connectors of the battery.

Preferably the blocking member comprises an upwardly extending leg joined to a foot, the foot having a battery face engaging portion, the engaging portion located adjacent the snap connectors of the battery support portion, wherein the engaging portion is displaced and held down by the face of the battery when the battery is installed thereby holding the blocking member into its retracted position.

Preferably the biasing means comprises a spring, for instance, a coil spring.

Preferably the means of connecting to the mains electricity comprises:

at least two terminals for receiving electrical wiring.

Preferably each terminal comprises:

a body defining a cylindrical recess for receiving a mains wire and defining a stud conductor; and a screw threadably received within a taped hole through the body into the cylindrical recess, wherein, in use, the screw clamps the wire in place within the cylindrical recess and power is transmitted from the wire into the body and out through the stud to the module.

Preferably the quick connection means comprises at least two co-operable pairs of conductors, in use the conductor pairs transmitting power from the base to the detector module, the pairs of conductors each comprising:

the stud conductor; and a forked conductor mounted to the module, wherein the conductors are mutually shaped and constructed so as to provide sufficient mechanical holding strength to support the module against gravity.

Preferably each forked conductor comprises two spaced apart resilient prongs, the prongs biased towards each other to grip the stud.

Preferably the forked conductors are constructed from phosphor bronze.

According to a second aspect of the invention there is provided a detector assembly powered by mains electricity and a backup battery, the assembly comprising:

a ceiling mountable base having: a body defining a downwardly opening socket, and a means of connecting to the mains electricity;

a detector module having a battery support portion, the module receivable by the socket;

a quick connection means for mechanically connecting the detector module to the base;

a quick connection means for electrically connecting the detector module to the base; and a lockout means having a shutter mounted to the base, wherein the lockout means prevents operation of at least the mechanical quick connection means when no battery is installed within the detector module.

Preferably the battery support portion is arranged and constructed to hold a battery such that it protrudes upwards to engage the shutter mounted to the base.

Preferably the body of the base defines an mouth for receiving a portion of the battery.

Preferably the body of the base defines an aperture positioned adjacent the mouth, the aperture providing a path through which the mechanical quick connection means can operate.

Preferably the shutter comprises:

a leg having an upper end and a lower end, the upper end connected to an upper end of the mouth; and a foot connected to the lower end of the leg, the foot having a blocking portion, the blocking portion extending over the aperture so as to block the path through which the quick connection means operates when the shutter is in the closed position.

Preferably the means of connecting to the mains electricity comprises:

at least two terminals for receiving electrical wiring.

Preferably each terminal comprises:

a body defining a cylindrical recess for receiving a mains wire and defining a stud conductor; and a screw threadably received within a taped hole through the body into the cylindrical recess, wherein, in use, the screw damps the wire in place within the cylindrical recess and power is transmitted from the wire into the body and out through the stud conductor to the module.

Preferably the quick connection means for mechanically connecting the detector module to the socket and the quick connection means for electrically connecting the detector module to the socket are a single quick connection means.

Preferably the quick connection means comprises at least two co-operable pairs of conductors, in use the conductor pairs transmitting power from the base to the detector module, the pairs of conductors each comprising:

the stud conductor; and a forked conductor mounted to the module, wherein the conductors are mutually shaped and constructed so as to provide sufficient mechanical holding strength to support the module against gravity.

Preferably each forked conductor comprises two spaced apart resilient prongs, the prongs biased towards each other to grip the stud.

Preferably the forked conductors are constructed from phosphor bronze.

Preferably the body is shaped to define a post the inside of which forms the mouth.

Preferably the post has a recess for receiving a cable tie to facilitate retention of a mains electrical cable.

DETAILED DESCRIPTION OF A PREFERRED EMBODIMENT OF THE INVENTION

A preferred embodiment of the invention is illustrated in the accompanying representations in which.

Figure 1:
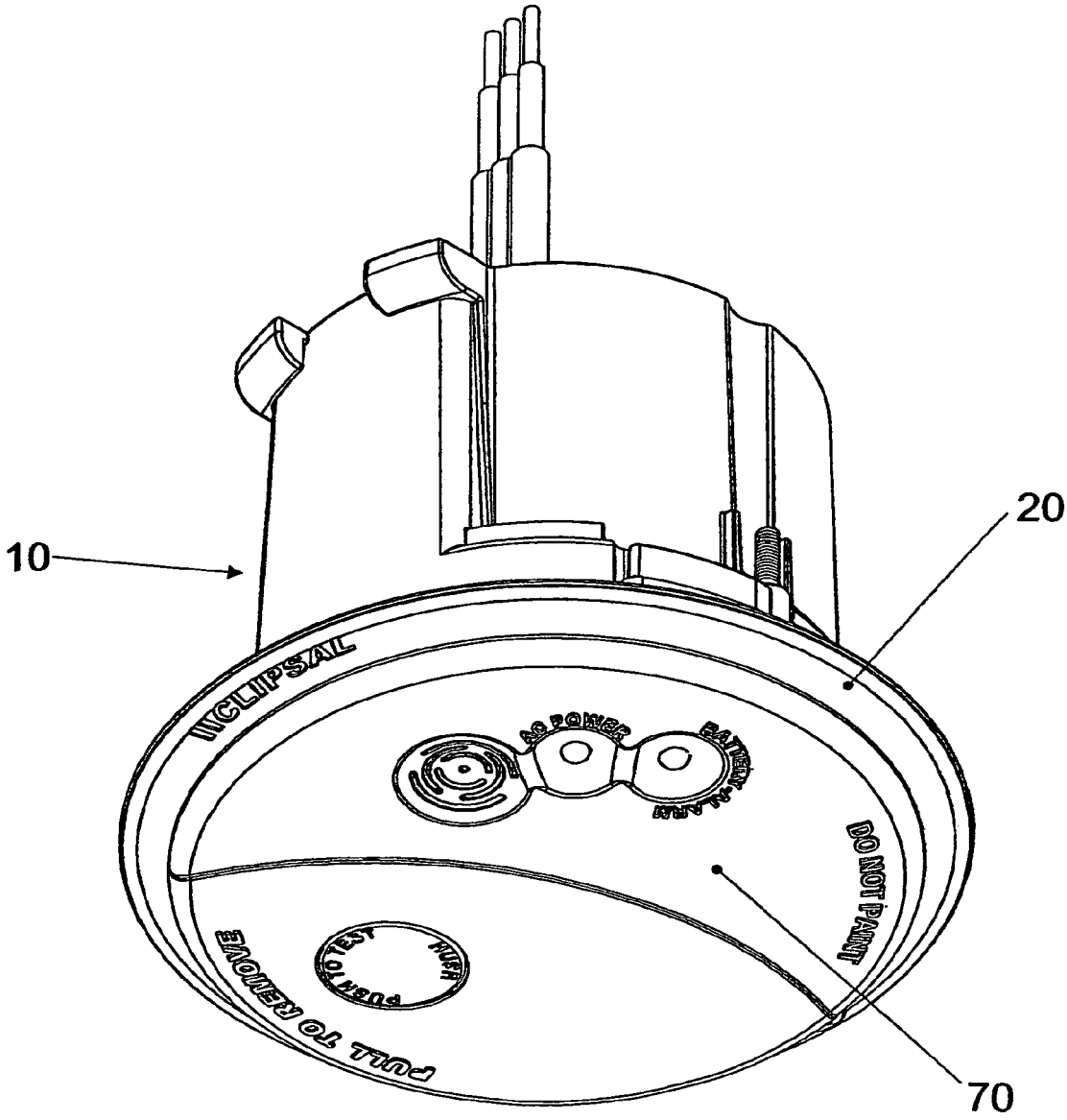
FIG. 1 is a perspective view of an assembled detector assembly according to a first embodiment of the invention.
Figure 4:
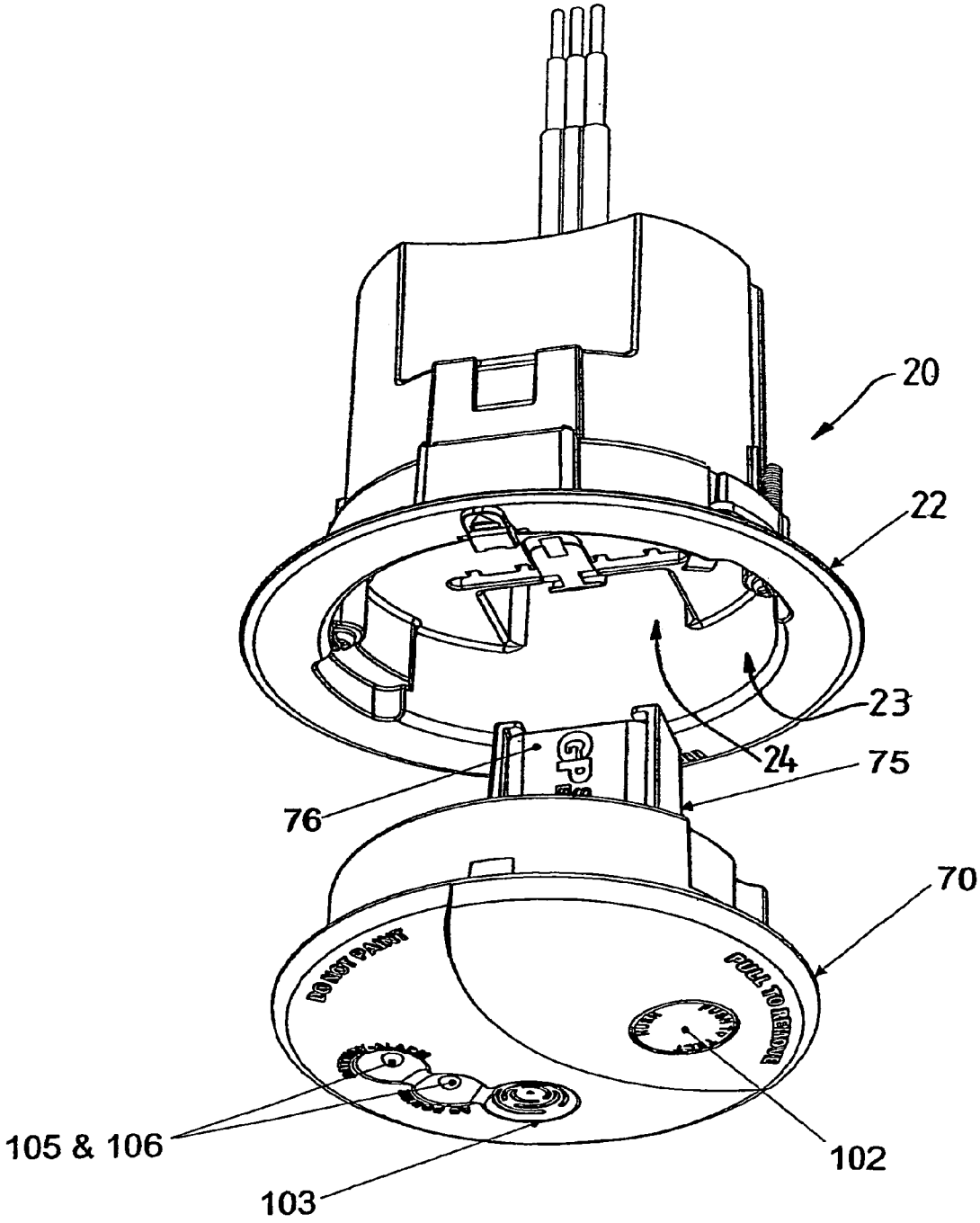
FIG. 4 shows the assembly of FIG. 1 in a disassembled perspective view.

Referring to FIG. 1, a low profile smoke detector assembly 10 according to a first embodiment of the invention is shown. The detector assembly 10 comprises two main components, a ceiling mountable base 20 and a plug in detector module 70. Referring to FIG. 4, the base 20 has a body 22 defining a downwardly opening socket 23 and a mouth 24 within the socket 23 for receiving a portion of a backup battery 76.

Figure 2:
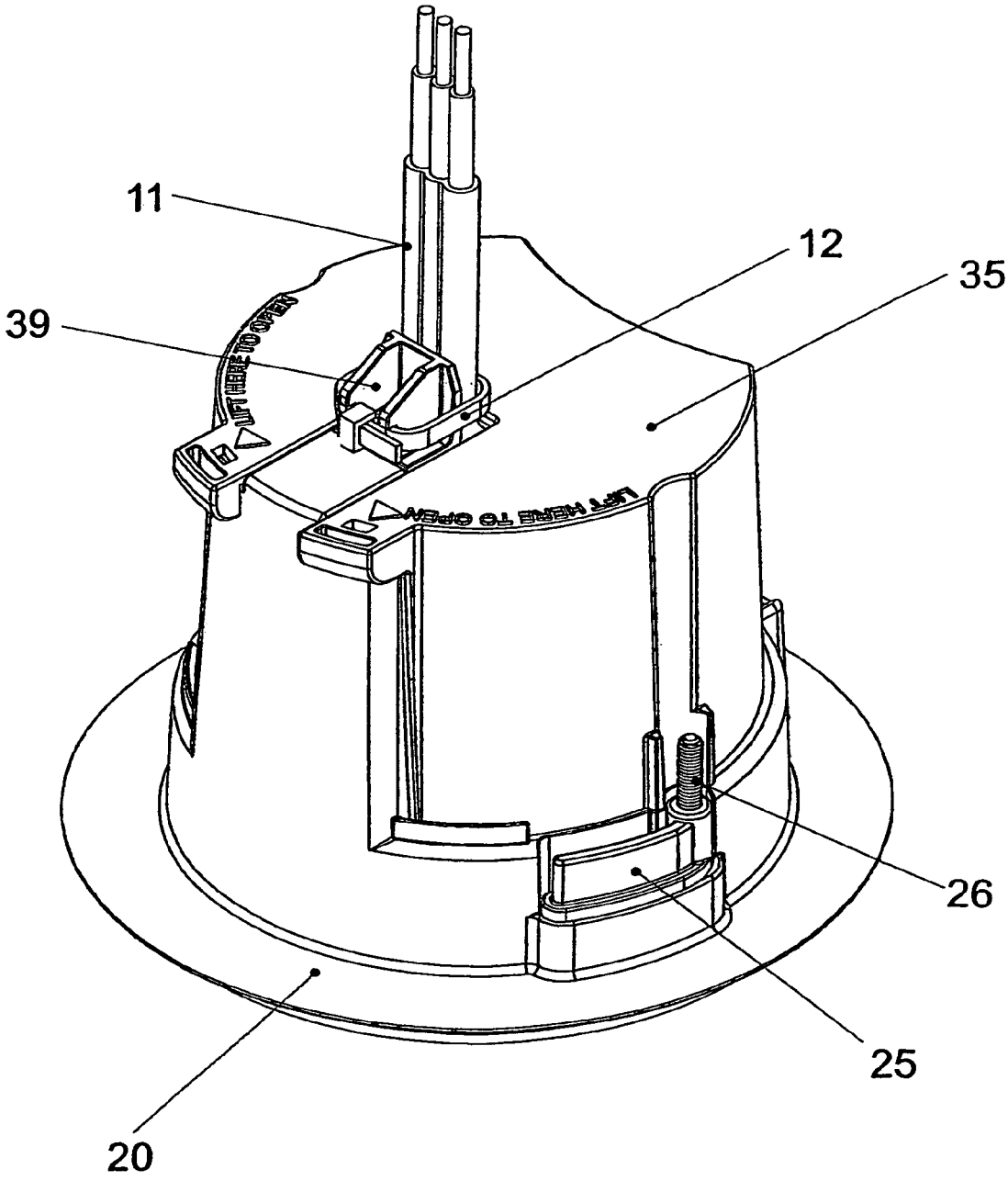
FIG. 2 is a top perspective view of a ceiling mountable base component of the detector assembly of FIG. 1.
Figure 3:
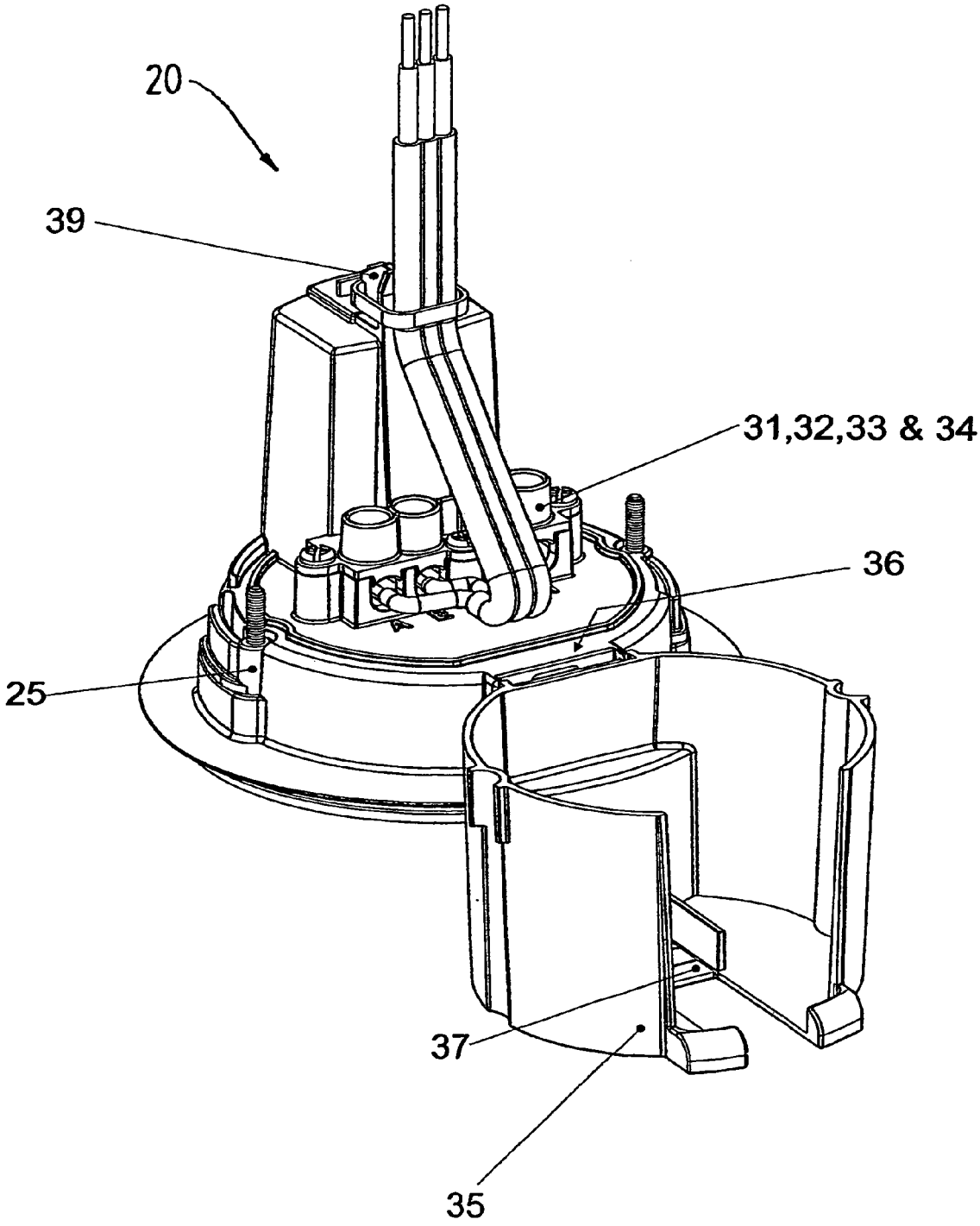
FIG. 3 is a similar view to that of FIG. 2 but with the hinged cover in an open position.
Figure 12:
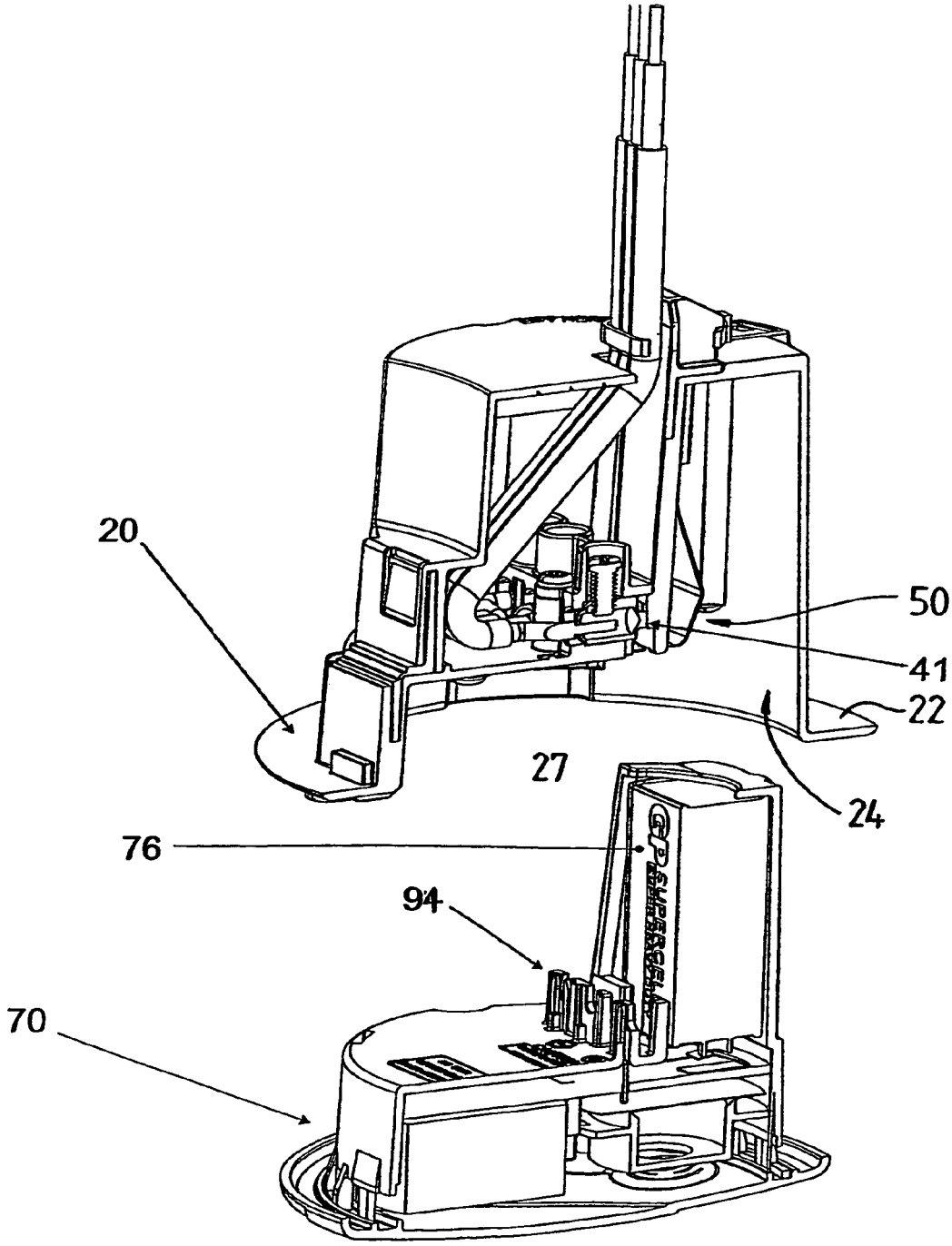
FIG. 12 shows a cutaway cross sectional perspective view of the detector assembly shown in FIG. 4.

Referring to FIGS. 2 and 3, it can be seen that the base 20 is mountable in a ceiling through a circular cut out using mounting arms 25. Mounting arms 25 rotate about mounting screws 26. A cover 35 is mounted about a hinge 36 to double insulate the terminal area in the roof cavity. The top cover 35 includes a break out area 37 for up to three additional cables. Upright portion or post 39 is provided by body 22 to enable secure connection of the power supply cable using a cable tie 12 as is shown in FIGS. 1 and 12. The same post 39 forms the mouth 24 for receiving a portion of the battery 76.

Figure 10:
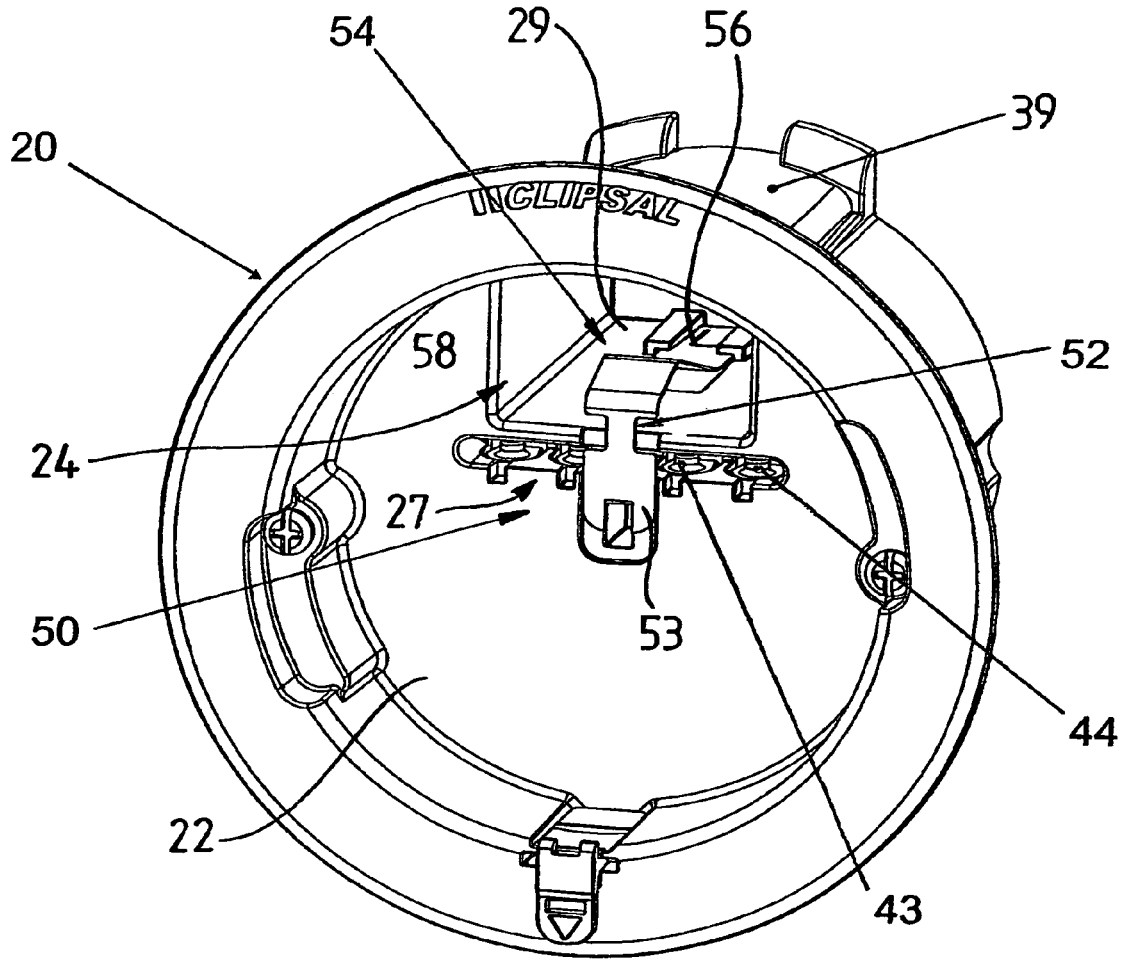
FIGS. 10 and 11 show an underside perspective view of the socket of FIG. 5 in respective locked out and unlocked out conditions.

Referring to FIGS. 10 and 12, it can be seen that the body 22 of the base 20 defines an aperture 27 position adjacent the mouth 24. The aperture 27 provides a path for electrical connection between the detector module 70 and the base 20.

Figure 9:
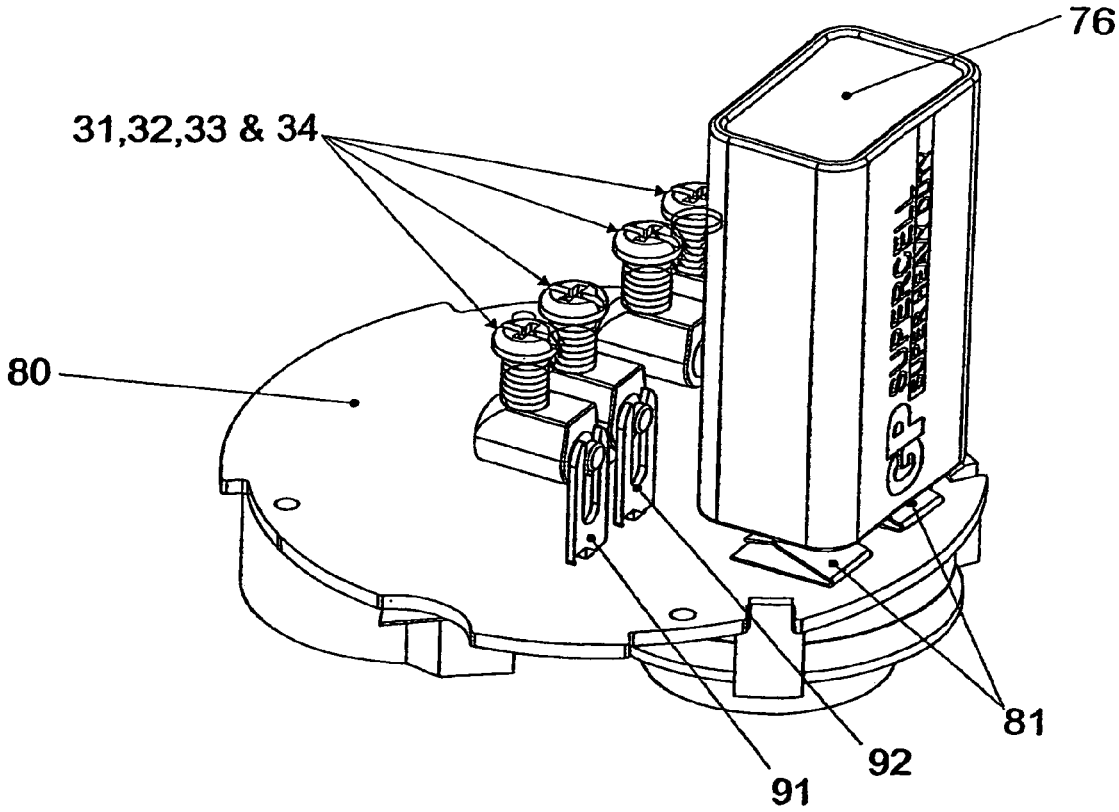
FIG. 9 shows a perspective view of a component of both the detector module and the base shown in FIGS. 6 and 7.
Figure 13:
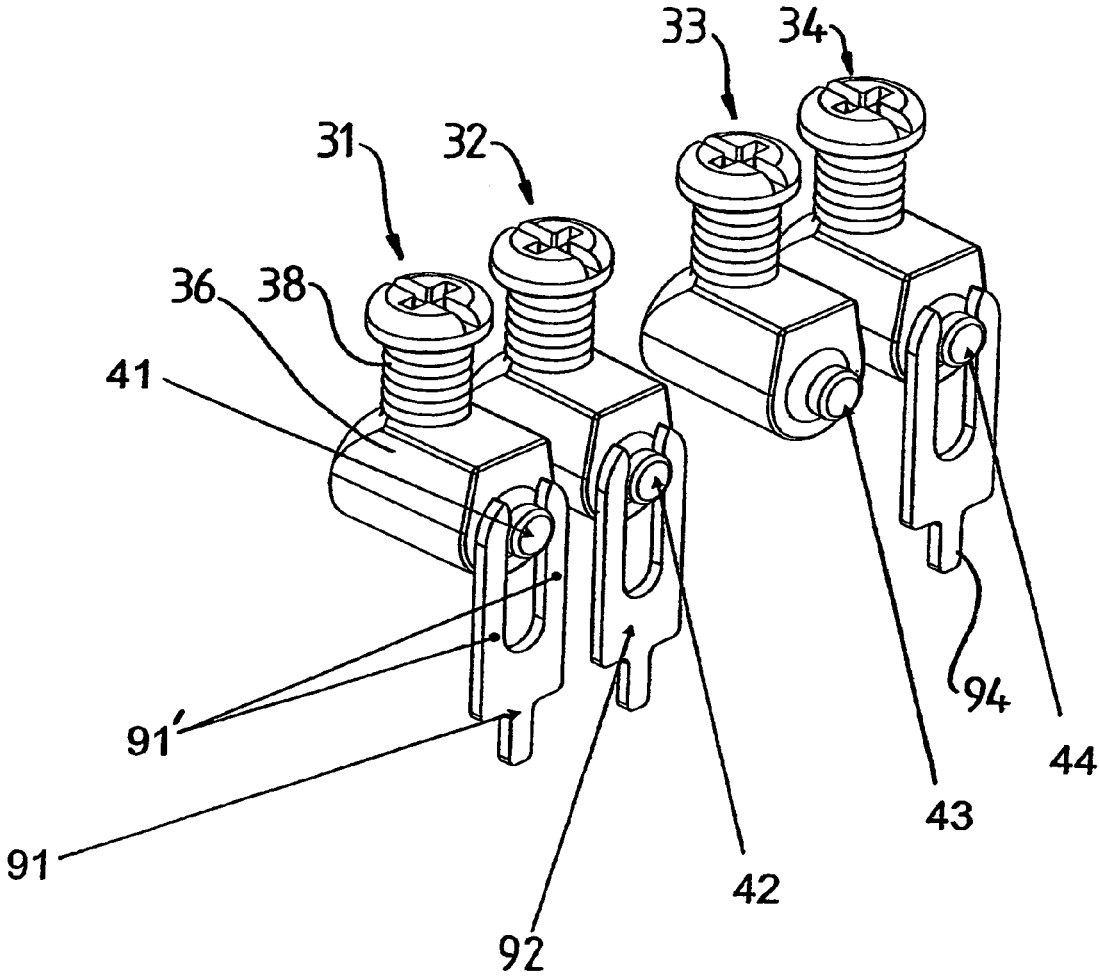
FIG. 13 shows a perspective view of components of the detector assembly as shown in FIG. 12.

A means of connecting the assembly 10 to mains electricity is provided by four terminals A E N I (Active, Earth, Neutral, Interconnect). The terminals are arranged in line making wiring easy as is shown in FIGS. 3, 9 and 12. The diameter of the terminals 31, 32, 33 and 34 is preferably five millimeters. Connection of wiring to these terminals is made easy by the fact that the top cover 35 can flip open 180 degrees giving dear access to the terminal area as is shown in FIG. 3. Referring to FIG. 13, the construction of each of the terminals 31, 32, 33 and 34 can be seen. For instance, terminal 31 comprises a body 36 that defines a cylindrical recess for receiving a mains wire and a screw 38 threadable received within a tapped hole through the body 36 into the cylindrical recess. A stud conductor 41 is also defined by the body 36. In use, the screw 38 clamps the wire in place within the cylindrical recess and power is transmitted from the wire into the body 36 and out through the stud conductor 41 to the detector module 70.

Referring to FIG. 4, it can be seen that the detector module 70 has a battery support portion 75 that holds the battery 76 in a vertical orientation extending away from and protruding from the body of the detector module 70. In other embodiments of the invention the battery may be mounted on its side with one side extending away from the body of the detector module.

A quick connection means for mechanically and electrically connecting the detector module 70 to the base 20 is provided. The quick connection means comprises at least two cooperable pairs of conductors, in use the conductor pairs transmitting power from the base 20 to the detector module 70. The pairs of conductors are most clearly shown in FIGS. 12 and 13. They are mutually shaped and constructed so as to provide sufficient mechanical holding strength to support the module against gravity.

In another embodiment of the invention, quick connection means for mechanical connection and for electrical connection may be separate.

More specifically, each of the cooperable pairs of conductors comprises a stud conductor, such as the stud conductor 41 shown in FIG. 13, and a forked conductor, such as a conductor 91 shown in the same Figure. Forked conductor 91 has a pair of spaced apart resilient prongs 91' that are biased towards each other and are disposed on opposite sides of the stud 41 thereby gripping the stud 41. The slot formed between each pair of prongs ensures that contact with the corresponding stud is achieved in spite of height differences arising from manufacturing tolerance variations.

Figure 5:
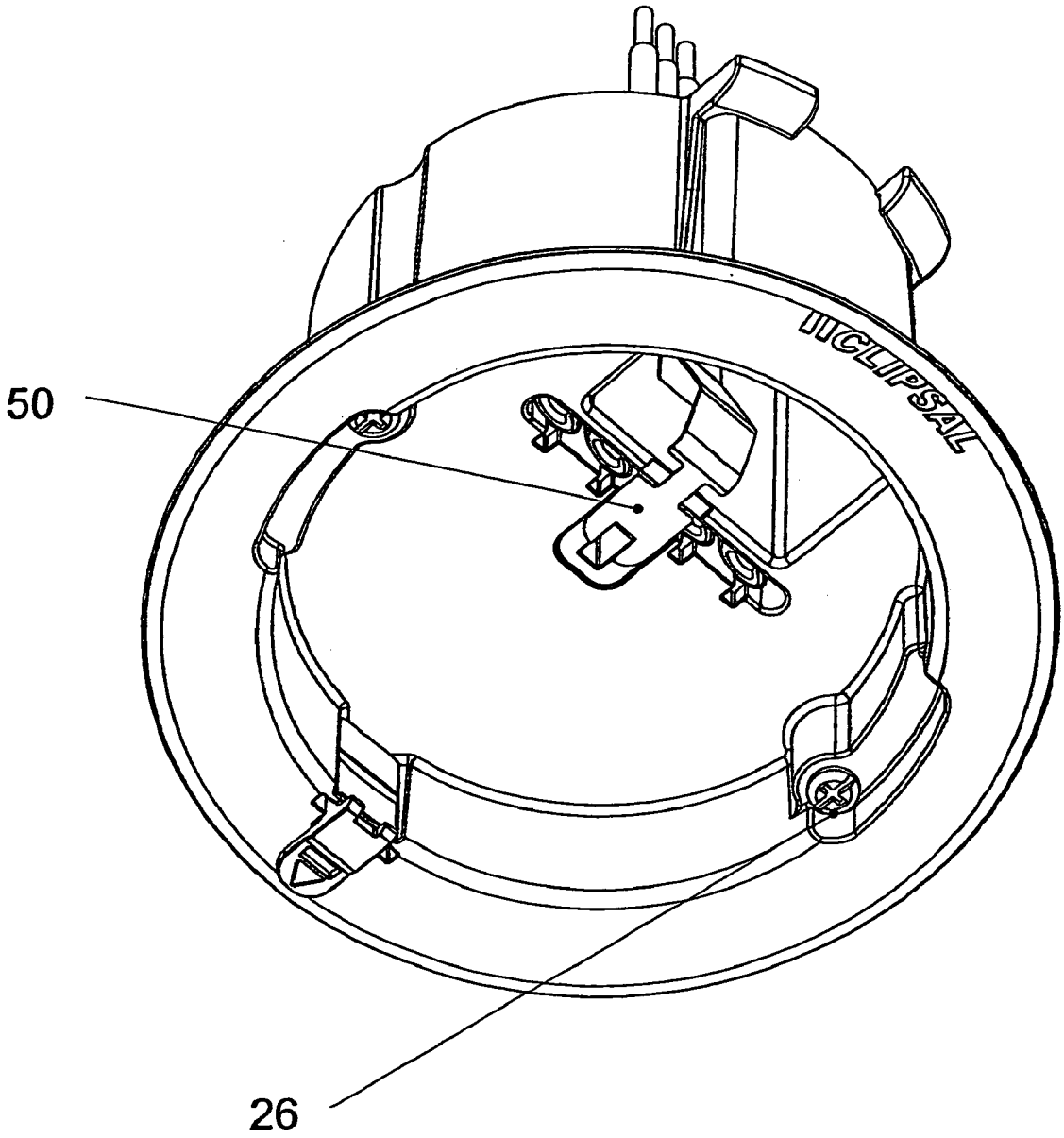
FIG. 5 shows an underside view of the ceiling mountable base shown in FIGS. 2 and 3.
Figure 11:
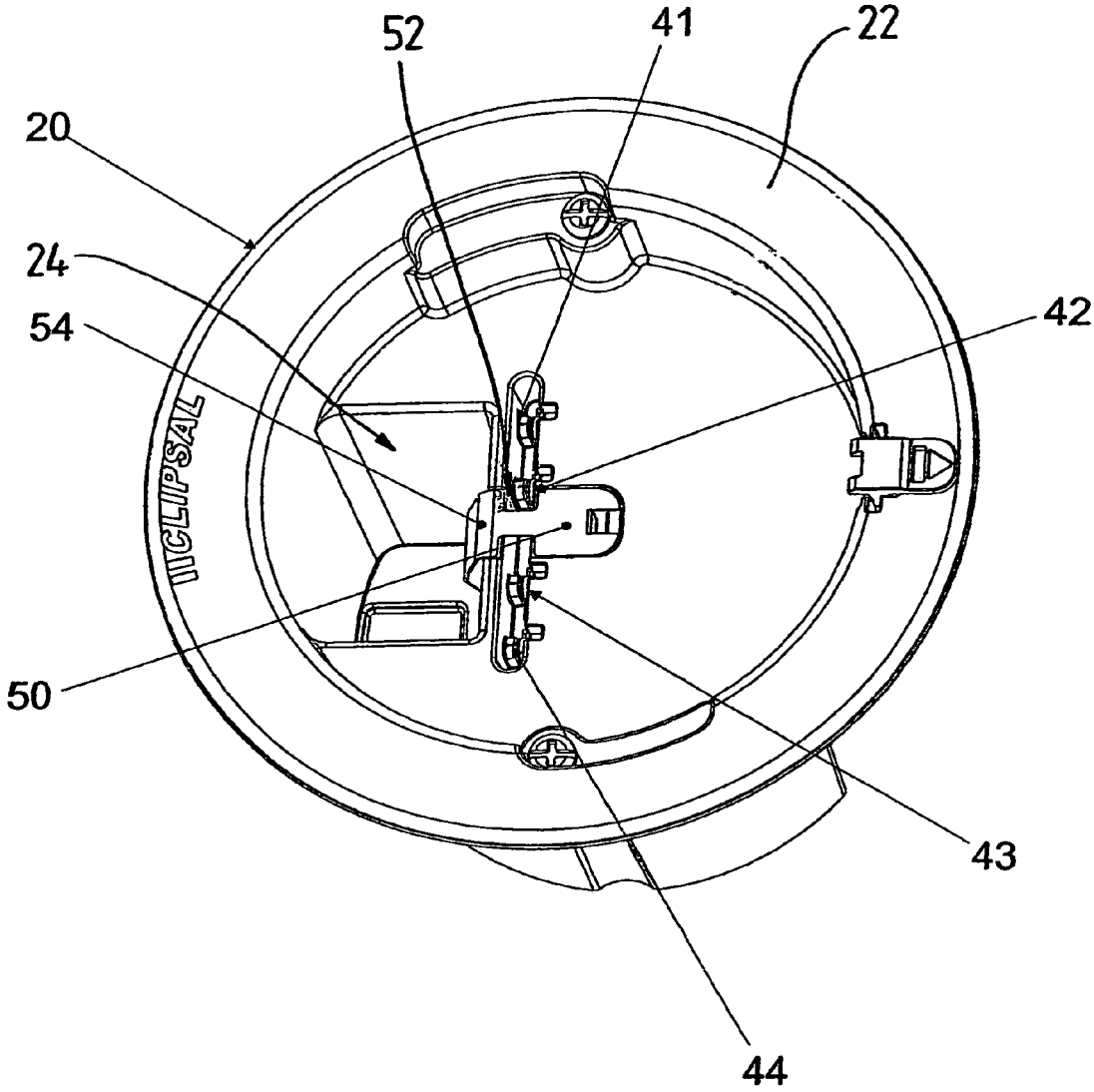

The lockout means is arranged to prevent operation of the above described connection means when no battery is installed within the detector module 70. The lockout means includes a shutter 50 mounted to the base 20 as shown in FIGS. 5, 10 and 11. The construction of the shutter is best seen in FIG. 10. FIG. 10 shows that the shutter includes a leg 54 having an upper end 56 connected to an upper end 29 of the mouth 24. A foot 53 is connected to the lower end 58 of the leg 54. The foot 53 has a blocking portion, the blocking portion extending over the aperture 27 so as to block the path through which the quick connection means operates when the shutter is in its dosed position as shown in FIG. 10. In this position, cut outs 52 are not aligned with the row of terminal studs 41, 42, 43 and 44 and therefore the central forked conductors 92 and 93 are mechanically blocked from engaging the studs 42 and 43.

The shutter 50 is shaped and positioned such that when a battery 76 is installed in the detector module 70, as is shown in FIG. 4, the battery 76 will displace it as the detector module 70 is inserted up into the base 20. This is best seen in the cutaway view of FIG. 12. The upper part of the battery 76 engages the leg 54 of the shutter 50 before the top of the forked conductor 92 reaches the cut out area 52. The cut out area 52 is in the position shown in FIG. 11 by the time the forked conductor 92 is about to pass through towards the terminal stud 42.

It can be seen that electrical connection between the detector module 70 and the ceiling mountable base 20 is made via linear connection rather than by a plug in terminal or a rotating connection as is commonly used in other smoke detector systems.

Figure 6:
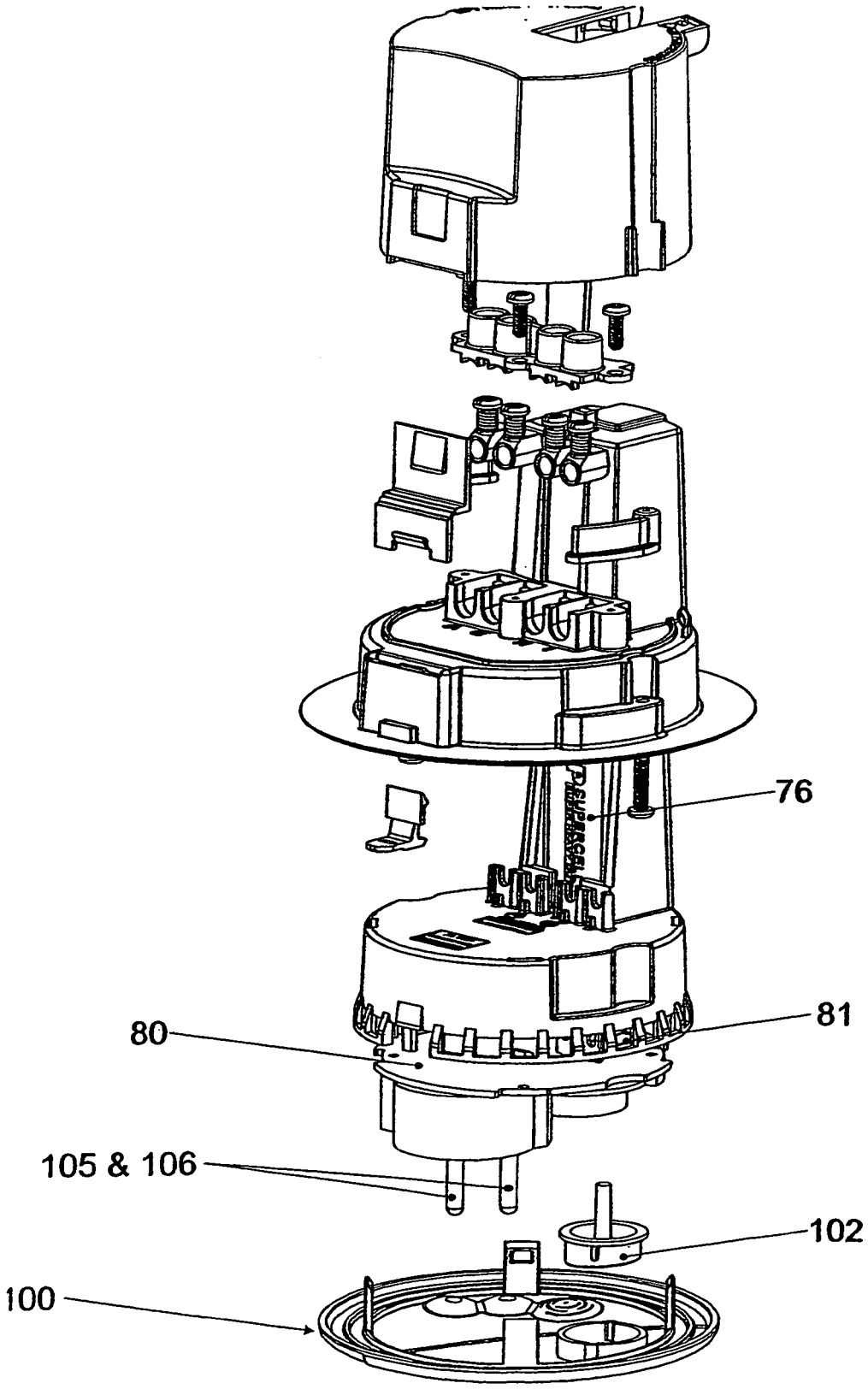
FIG. 6 shows an exploded top perspective view of the assembly of FIG. 1.
Figure 7:
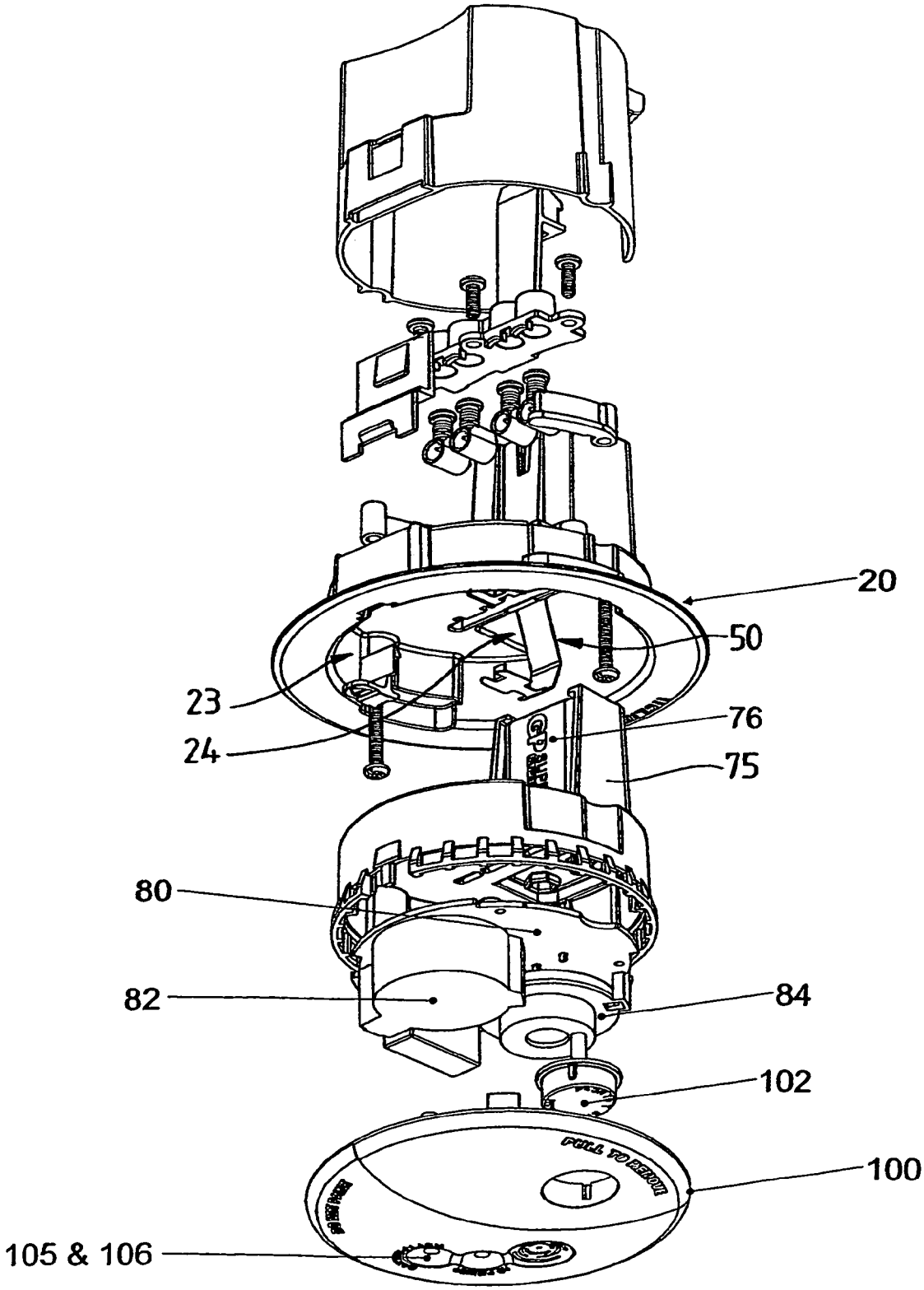
FIG. 7 shows an underside perspective exploded view of assembly of FIG. 1.
Figure 8:
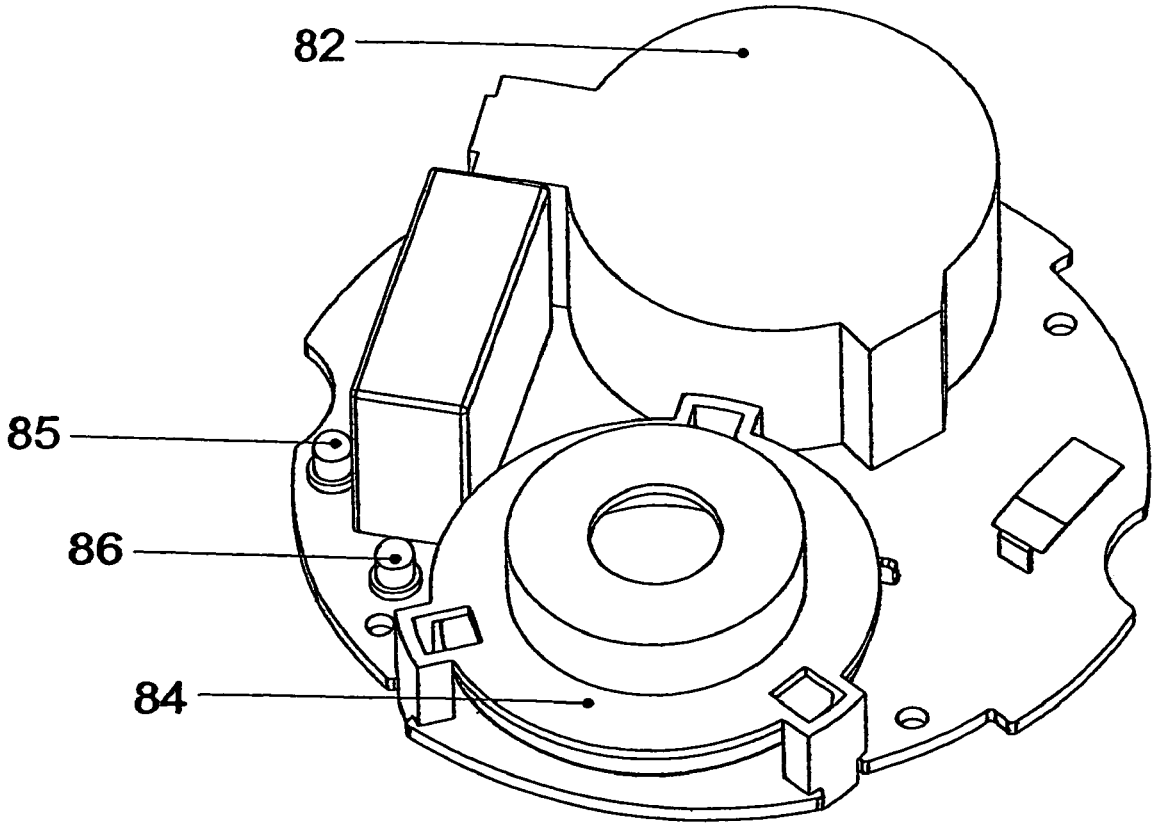
FIG. 8 shows a perspective view of a component of the detector module component shown in FIGS. 6 and 7.

The printed circuit board 80 housed within the detector module 70 is shown in FIGS. 6, 7, 8 and 9. Referring to FIG. 8, a sensor 82 is shown. In this embodiment of the invention the sensor 82 is a smoke sensor. However, in other applications, a carbon monoxide or other type of detector may be fitted. A horn 84 is provided to produce a loud warning signal. Conventional red and green LEDs 85 and 86 are provided together with light pipes 105 and 106 (light pipes shown in FIGS. 4 and 6). A push-to-test button 102 is provided as shown in FIGS. 6 and 7.

FIG. 9 shows how the battery 76 simply engages battery contacts 81. The terminals 31, 32, 33 and 34, although shown in FIG. 9 for clarity of illustration, are in fact located within the ceiling mountable base 20. Thus FIG. 9 shows how the terminal 31, 32, 33 and 34 engage with the contact tabs 91, 92, 93 and 94 when the detector module 70 is installed with a battery 76 within the ceiling mountable base 20.

Figure 14:
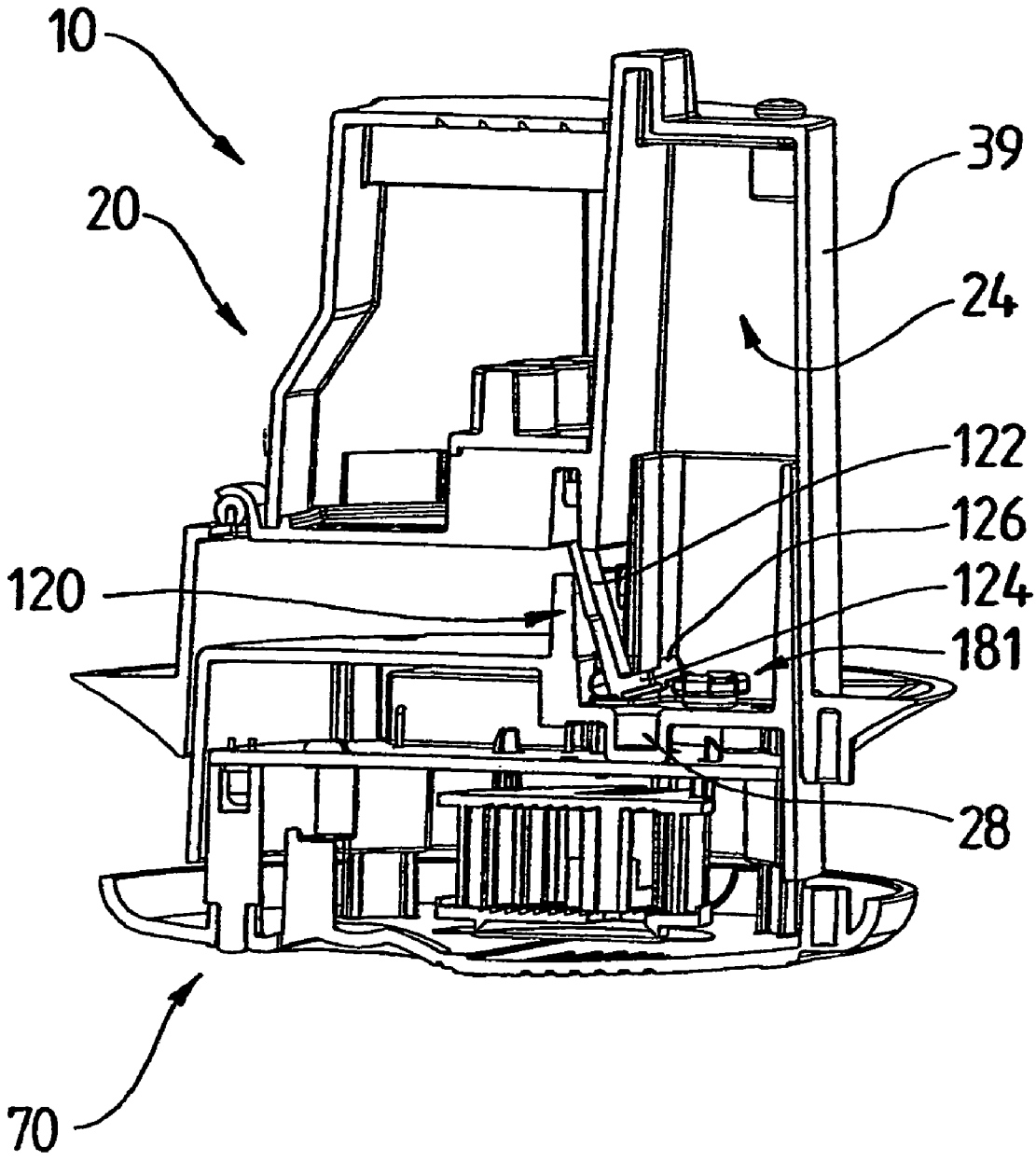
FIG. 14 shows a cut away cross-section perspective view of a detector assembly according to a second embodiment of the invention in a partially assembled form.
Figure 15:
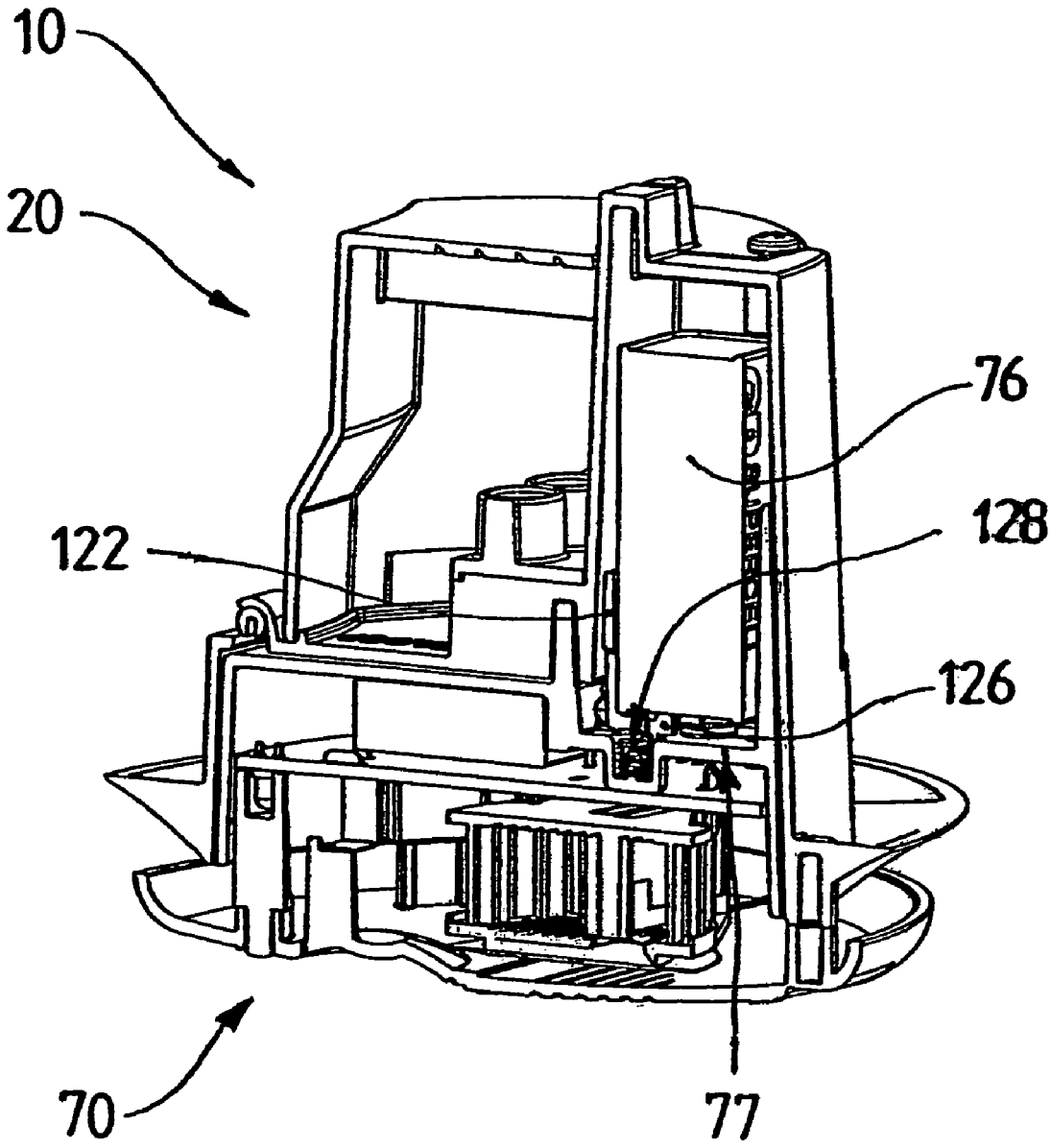
FIG. 15 is a similar view to that of FIG. 14 but shows the detector assembly in a fully assembled state with a battery installed.

A second embodiment of the invention is shown in FIGS. 14 and 15. This embodiment of the invention is similar to the first embodiment of the invention described above except for the lockout means. Referring to FIGS. 14 and 15, it can be seen that the lockout means for the second embodiment of the invention comprises a blocking member 120 pivotably mounted to the module 70 for rotation from a blocking position to a retracted position. The blocking member is shown in its blocking position in FIG. 14 and its retracted position in FIG. 15. The lockout means also comprises a biasing means in the form of a spring 128 positioned within recess 28 for biasing the blocking member 120 into its blocking position when no batteries are installed within the detector module as shown FIG. 14. The spring 128 is dearly shown in FIG. 15, but has been omitted from FIG. 14 for clarity.

With this embodiment of the invention, the battery contact 81 of the first embodiment of the invention has been replaced with standard snap connectors 181 as shown in FIG. 14. These snap connectors engage with the standard projecting spaced apart snap connectors mounted on the end face of a standard knife or battery.

Referring again to FIG. 14, the blocking member 120 comprises an upwardly extending leg 122 joined to a foot 124, the foot having a battery face engaging portion 126 located adjacent snap connectors 181 of the battery support portion. Referring to FIG. 15 it can be seen that the engaging portion 126 is displaced and held down by the face 77 of the battery 76 when the battery 76 is installed, thereby holding the blocking member 120 into its retracted position. In this retracted position, the leg 122 of the blocking member 120 is adjacent and parallel to the battery 76 allowing it to enter the mouth within the base 20.

It can be seen that the above described detector assemblies 10 both provide a compact low profile smoke detector that is easy to install by an electrical contractor.

While the present invention has been described in terms of a preferred embodiment in order to facilitate better understanding of the invention, it should be appreciated that various modifications can be made without departing from the principals of the invention. Therefore, the invention should be understood to include all such modifications within its scope.

The invention claimed is:

1. A detector assembly powered by mains electricity and an elongate backup battery, the assembly comprising:

a ceiling mountable base having: a body defining a downwardly opening socket, a mouth within the socket for receiving a portion of the battery, and a means of connecting to the mains electricity;

a detector module having a battery support portion for holding the battery in a vertical orientation, the module receivable by the socket;

a mechanical quick connection means for mechanically connecting the detector module to the base;

an electrical quick connection means for electrically connecting the detector module to the base, the electrical connection supplying power from the mains electricity to the module; and a lockout means arranged to prevent operation of at least the mechanical quick connection means when no battery is installed within the detector module.

2. An assembly as claimed in claim 1 wherein the lockout means comprises:

a blocking member pivotally mounted to the module for rotation from a blocking position to a retracted position; and a biasing means for biasing the blocking member into its blocking position when no battery is installed within the detector module.

3. An assembly as claimed in claim 2 for use with a standard nine volt battery having an end face with a pair of projecting spaced apart snap connectors, wherein the battery support portion comprises a pair of standard upwardly facing snap connectors arranged and constructed to engage the snap connectors of the battery.

4. An assembly as claimed in claim 3 wherein the blocking member comprises an upwardly extending leg joined to a foot, the foot having a battery face engaging portion, the engaging portion located adjacent the snap connectors of the battery support portion, wherein the engaging portion is displaced and held down by the face of the battery when the battery is installed thereby holding the blocking member into its retracted position.

5. An assembly as claimed in claim 4 wherein the biasing means comprises a spring.

6. An assembly as claimed in claim 5 wherein the means of connecting to the mains electricity comprises:

at least two terminals for receiving electrical wiring.

7. An assembly as claimed in claim 1 wherein each terminal comprises:

a body defining a cylindrical recess for receiving a mains wire and defining a stud conductor; and a screw threadably received within a taped hole through the body into the cylindrical recess, wherein, in use, the screw clamps the wire in place within the cylindrical recess and power is transmitted from the wire into the body and out through the stud conductor to the module.

8. An assembly as claimed in claim 7 wherein the mechanical quick connection means and the electrical quick connection means are a single quick connection means comprising at least two co-operable pairs of conductors, in use the conductor pairs transmitting power from the base to the detector module, the pairs of conductors each comprising:

the stud conductor; and a forked conductor mounted to the module, wherein the conductors are mutually shaped and constructed so as to provide sufficient mechanical holding strength to support the module against gravity.

9. An assembly as claimed in claim 8 wherein each forked conductor comprises two spaced apart resilient prongs, the prongs biased towards each other to grip the stud conductor.

10. An assembly as claimed in claim 9 wherein the forked conductors are constructed from phosphor bronze.

11. A detector assembly powered by mains electricity and a backup battery, the assembly comprising:

a ceiling mountable base having: a body defining a downwardly opening socket, and a means of connecting to the mains electricity;

a detector module having a battery support portion, the module receivable by the socket;

a mechanical quick connection means for mechanically connecting the detector module to the base;

an electrical quick connection means for electrically connecting the detector module to the base; and a lockout means having a shutter mounted to the base, wherein the lockout means prevents operation of at least the mechanical quick connection means when no battery is installed within the detector module.

12. An assembly as claimed in claim 11 wherein the battery support portion is arranged and constructed to hold a battery such that it protrudes upwards to engage the shutter mounted to the base.

13. An assembly as claimed in claim 12 wherein the body of the base defines an mouth for receiving a portion of the battery.

14. An assembly as claimed in claim 13 wherein the body of the base defines an aperture positioned adjacent the mouth, the aperture providing a path through which the mechanical quick connection means can operate.

15. An assembly as claimed in claim 14 wherein the shutter comprises:

a leg having an upper end and a lower end, the upper end connected to an upper end of the mouth; and a foot connected to the lower end of the leg, the foot having a blocking portion, the blocking portion extending over the aperture so as to block the path through which the mechanical quick connection means operates when the shutter is in the closed position.

16. An assembly as claimed in claim 15 wherein the means of connecting to the mains electricity comprises:

at least two terminals for receiving electrical wiring.

17. An assembly as claimed in claim 16 wherein each terminal comprises:

a body defining a cylindrical recess for receiving a mains wire and defining a stud conductor; and a screw threadably received within a taped hole through the body into the cylindrical recess, wherein, in use, the screw clamps the wire in place within the cylindrical recess and power is transmitted from the wire into the body and out through the stud conductor to the module.

18. An assembly as claimed in claim 17 wherein the quick connection means for mechanically connecting the detector module to the socket and the quick connection means for electrically connecting the detector module to the socket are a single quick connection means.

19. An assembly as claimed in claim 18 wherein the mechanical quick connection means and the electrical quick connection means are a single quick connection means comprising at least two co-operable pairs of conductors, in use the conductor pairs transmitting power from the base to the detector module, the pairs of conductors each comprising:

the stud conductor; and a forked conductor mounted to the module, wherein the conductors are mutually shaped and constructed so as to provide sufficient mechanical holding strength to support the module against gravity.

20. An assembly as claimed in claim 19 wherein each forked conductor comprises two spaced apart resilient prongs, the prongs biased towards each other to grip the stud conductor.

21. An assembly as claimed in claim 20 wherein the forked conductors are constructed from phosphor bronze.

22. An assembly as claimed in claim 1 wherein the body is shaped to define a post the inside of which forms the mouth.

23. An assembly as claimed in claim 22 wherein the post has a recess for receiving a cable tie to facilitate retention of a mains electrical cable.

* * * * *